US006312315B1

(12) United States Patent
Gagliardi

(10) Patent No.: US 6,312,315 B1
(45) Date of Patent: Nov. 6, 2001

(54) ABRASIVE ARTICLE WITH SEPARATELY FORMED FRONT SURFACE PROTRUSIONS CONTAINING A GRINDING AID AND METHODS OF MAKING AND USING

(75) Inventor: John J. Gagliardi, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/677,115

(22) Filed: Sep. 29, 2000

Related U.S. Application Data

(62) Division of application No. 09/128,692, filed on Aug. 5, 1998.

(51) Int. Cl.[7] ..... B24B 1/00

(52) U.S. Cl. ..... 451/28; 451/46; 451/51; 451/295; 451/297; 451/526

(58) Field of Search ..... 451/28, 46, 51, 451/526, 295, 297

(56) References Cited

U.S. PATENT DOCUMENTS

| | | |
|---|---|---|
| 2,347,244 | 4/1944 | Colt et al. . |
| 2,542,058 | 2/1951 | Riedesel . |
| 3,090,061 | 5/1963 | Charvat . |
| 3,134,122 | 5/1964 | Charvat . |
| 3,246,430 | 4/1966 | Hurst . |
| 3,301,741 | 1/1967 | Hendrickson et al. . |
| 3,562,968 | 2/1971 | Johnson et al. . |
| 3,918,217 | 11/1975 | Oliver . |
| 3,985,521 | 10/1976 | Borchard et al. . |
| 4,078,340 | 3/1978 | Klecker et al. . |
| 4,093,440 | 6/1978 | Denninger et al. . |
| 4,111,666 | 9/1978 | Kalbow . |
| 4,142,334 | 3/1979 | Kirsch et al. . |
| 4,255,164 | 3/1981 | Butzke et al. . |
| 4,311,489 | 1/1982 | Kressner . |
| 4,314,827 | 2/1982 | Leitheiser et al. . |

(List continued on next page.)

FOREIGN PATENT DOCUMENTS

| | | |
|---|---|---|
| 26 50 942 | 5/1978 | (DE) . |
| 2 068 275 | 8/1981 | (DE) . |
| 195 80 280 | 6/1996 | (DE) . |
| 2 624 773 | 12/1987 | (FR) . |
| 2 043 501 | 10/1980 | (GB) . |
| 2 280 142 | 1/1995 | (GB) . |
| 7-156070 | 6/1995 | (JP) . |
| WO 92/05915 | 4/1992 | (WO) . |
| WO 94/02562 | 2/1994 | (WO) . |
| WO 95/20469 | 8/1995 | (WO) . |
| WO 95/24991 | 9/1995 | (WO) . |
| WO 98/10896 | 3/1998 | (WO) . |
| WO 98/30358 | 7/1998 | (WO) . |

OTHER PUBLICATIONS

Patent Abstracts of Japan, vol. 010, No. 249 (M–511), Aug. 27, 1986 & JP 61 079576 (Kouyoushiya:KK), Apr. 23, 1986.
Patent Abstracts of Japan, vol. 097, No. 011, Nov. 28, 1997 & JP 09 193021 A (Showa Gomme KK:Tokyo Daiyamondo Kogu Seisakusho:KK; Mayekawa Mfg Co Lt), Jul. 29, 1997.

* cited by examiner

*Primary Examiner*—Joseph J. Hail, III
*Assistant Examiner*—Shantcoe McDonald
(74) *Attorney, Agent, or Firm*—Gregory D. Allen

(57) ABSTRACT

An abrasive article including (i) a first backing, (ii) a plurality of protrusions attached to the first surface of the first backing and including a grinding aid, wherein the first surface of the first backing is contoured by the protrusions so as to define a plurality of peaks and valleys, and (iii) a coating of abrasive particles adhered to the contoured first surface of the first backing so as to cover at least a portion of both the peaks and the valleys.

26 Claims, 2 Drawing Sheets

U.S. PATENT DOCUMENTS 4,317,660 3/1982 Kramis et al. .
4,381,188 4/1983 Waizer et al. .
4,623,364 * 11/1986 Cottringer et al. ..... 51/309
4,644,703 * 2/1987 Kaczmarek et al. ..... 51/401
4,652,274 3/1987 Boettcher et al. .
4,652,275 3/1987 Bloecher et al. .
4,735,632 4/1988 Oxman et al. .
4,744,802 5/1988 Schwabel .
4,773,920 9/1988 Chasman et al. .
4,799,939 1/1989 Bloecher et al. .
4,881,951 11/1989 Wood et al. .
4,903,440 2/1990 Larson et al. .
5,015,266 5/1991 Yamamoto .
5,039,311 8/1991 Bloecher .
5,077,870 1/1992 Melbye et al. .
5,078,753 1/1992 Broberg et al. .
5,174,795 12/1992 Wiand .
5,190,568 * 3/1993 Tselesin ..... 51/293
5,201,101 4/1993 Rouser et al. .
5,219,462 6/1993 Bruxvoort et al. .
5,232,470 8/1993 Wiand .
5,233,794 8/1993 Kikutani et al. .
5,236,472 8/1993 Kirk et al. .
5,316,812 5/1994 Stout et al. .
5,355,636 * 10/1994 Harmon ..... 51/295
5,378,251 1/1995 Culler et al. .
5,435,816 7/1995 Spurgeon et al. .
5,437,754 8/1995 Calhoun .
5,454,750 10/1995 Cosmano et al. .
5,500,273 3/1996 Holmes et al. .
5,505,747 4/1996 Chesley et al. .
5,578,098 11/1996 Gagliardi et al. .
5,609,706 3/1997 Benedict et al. .
5,658,184 8/1997 Hoopman et al. .
5,681,217 10/1997 Hoopman et al. .

ABRASIVE ARTICLE WITH SEPARATELY FORMED FRONT SURFACE PROTRUSIONS CONTAINING A GRINDING AID AND METHODS OF MAKING AND USING

This application is a Divisional of Ser. No. 09/128,692, filed Aug. 5, 1998.

FIELD OF THE INVENTION

This invention relates to abrasive articles and methods of making and using abrasive articles. More specifically, this invention relates to abrasive articles incorporating a grinding aid and methods of making and using such abrasive articles.

BACKGROUND OF THE INVENTION

Abrasive articles are used to abrade and finish a variety of workpieces ranging from high pressure metal grinding to the fine polishing of silicon wafers. In general, abrasive articles comprise a plurality of abrasive particles bonded to each other (e.g., a bonded abrasive or grinding wheel) or bonded to a backing (e.g., a coated abrasive sheet). Coated abrasives commonly include the sequential layers of backing, make coat, abrasive particles and size coat. The coated abrasive can further include an optional supersize coat over the size coat. Typically, the coated abrasives include a single layer of abrasive particles and a grinding aid incorporated into one of the layers (e.g., $KBF_4$ incorporated into the supersize coat) for purposes of increasing abrasion efficiency. Once the layer of abrasive particles are worn, the coated abrasive is spent and must be replaced. The industry is continuously seeking ways to extend the useful life of an abrasive article and/or increase the cutting rate of the abrasive article.

One attempt to extend the useful life of coated abrasives is described in U.S. Pat. Nos. 4,652,275; 4,799,939 and 5,039,311. The coated abrasives disclosed in these patents comprise a plurality of abrasive agglomerates bonded onto the upper surface of a backing, wherein the abrasive agglomerates are shaped masses of abrasive grains held together by a binder and optionally including a grinding aid and/or other additives.

Another attempt to extend the useful life of coated abrasives is described in U.S. Pat. Nos. 4,644,703, 4,773,920, 5,015,266 and 5,378,251, wherein an abrasive slurry comprising abrasive particles and a binder are bonded to a backing so as to form a lapping film.

These lapping films enjoy wide commercial success in polishing applications where a fine surface finish is desired. However, due to the limited rate of cut attainable with such lapping films, such films have enjoyed only limited success in many other applications.

Culler et al (U.S. Pat. No. 5,378,251) discloses an abrasive article comprising an abrasive slurry bonded to the front surface of a backing wherein the abrasive coating is a homogeneous mixture of abrasive particles, grinding aid and binder. Culler et al. discloses that the abrasive coating may be shaped to provide separate abrasive composites extending from the front surface of the abrasive article.

Tselesin (U.S. Pat. No. 5,190,568) discloses an abrasive article having a contoured front surface produced by coating a contoured backing with an abrasive slurry. Tselesin requires the backing to be constructed from a material which will wear quickly and be promptly removed from contact with a workpiece in order to avoid potentially deleterious contact between the backing and the workpiece.

Several different techniques have been developed for incorporating a grinding aid into a coated abrasive. It is a common practice to incorporate a grinding aid into the size coat and/or the super size coat used in the manufacture of coated abrasives.

Broberg et al. (U.S. Pat. No. 5,078,753) discloses an abrasive article containing erodible agglomerates of a resinous binder and an inorganic filler, such as cryolite, interspersed with abrasive particles. One of the embodiments disclosed by Broberg et al. includes erodible agglomerates positioned between elongated abrasive particles, wherein the erodible agglomerates and the abrasive particles are of substantially the same size.

Cosmano et al. (U.S. Pat. No. 5,454,750) discloses an abrasive article containing erodible agglomerates of a grinding aid or a combination of grinding aid and binder interspersed with the abrasive particles.

Gagliardi et al. (U.S. Pat. No. 5,578,098) discloses an abrasive article containing erodible agglomerates of a grinding aid or a combination of grinding aid and binder interspersed with the abrasive particles. One of the embodiments disclosed by Gagliardi et al. includes rod shaped agglomerates positioned between abrasive particles wherein the erodible agglomerates and the abrasive particles are of substantially the same size (i.e., ratio of maximum dimension of erodible agglomerates to maximum dimension of abrasive particles is between about 2.5:1 to about 0.5:1).

While such techniques are generally effective for incorporating effective amounts of a grinding aid into a coated abrasive, the search continues for improved techniques of incorporating a grinding aid into a coated abrasive.

SUMMARY OF THE INVENTION

We have discovered an abrasive article having an extended usefully life span effective for providing abrasion enhancing amounts of a grinding aid to the surface of the workpiece being abraded.

The abrasive article includes (i) a first backing, (ii) a plurality of protrusions attached to the first surface of the first backing and including a grinding aid, wherein the first surface of the first backing is contoured by the protrusions so as to define a plurality of peaks and valleys, and (iii) a coating of abrasive particles adhered to the contoured first surface of the first backing so as to cover at least a portion of both the peaks and the valleys.

The coating of abrasive particles covering the peaks have a limited thickness such that initial use of the abrasive article wears away the coating of abrasive particles covering the peaks of the protrusions, and thereby allows the protrusions to contact a workpiece.

In an alternative description of the invention, the abrasive article includes (i) a first backing, (ii) a plurality of protrusions adhered to the first surface of the first backing and including a grinding aid, wherein the first surface of the first backing is contoured by the protrusions so as to define (A) a plurality of peaks defining apexes, and (B) a plurality of valleys between the peaks defining base layer nadirs, and (iii) a coating of abrasive particles adhered to the contoured first surface of the first backing and defining (A) abrasive coated protrusions with each protrusion having an abrasive coated apex, and (B) abrasive coated valleys having an abrasive coated nadir, wherein the apex of a majority of the protrusions extend above at least one adjoining abrasive coated nadir.

The invention further includes a method of making the abrasive article involving the steps of (1) forming the protrusions, (2) attaching the protrusions to the first surface of the first backing to contour the first surface, and (3) coating abrasive particles onto the contoured first surface, whereby the protrusions are coated with abrasive particles.

The invention also includes a process for abrading a workpiece with the abrasive article involving the steps of obtaining a workpiece in need of abrasion, and abrading the workpiece with the abrasive article.

DETAILED DESCRIPTION OF THE INVENTION INCLUDING A BEST MODE

DEFINITIONS

Figure 1:
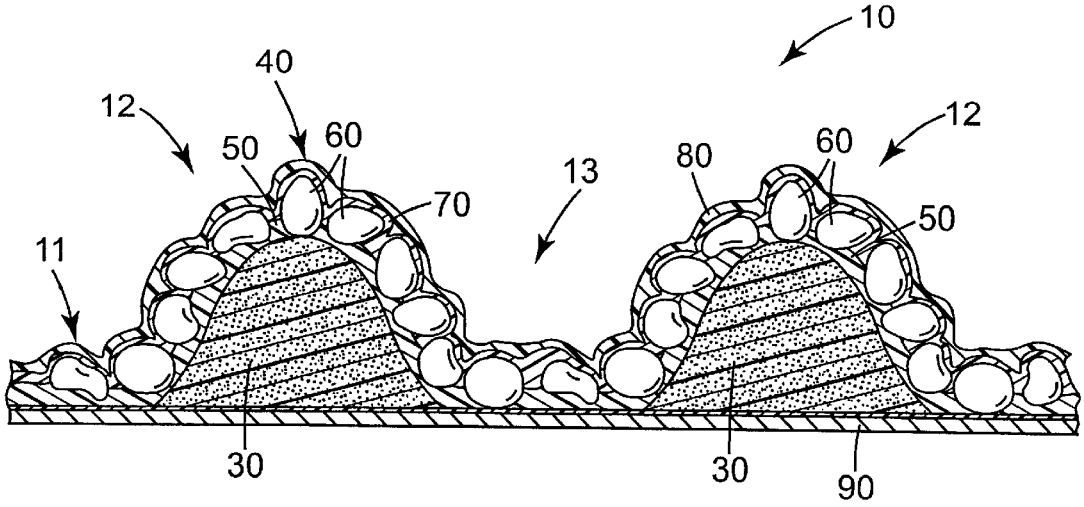
FIG. 1 is a cross-sectional side view of one embodiment of the invention.

As utilized herein, including the claims, the term "abrade" and "abrading" mean to remove material from a workpiece, typically a surface layer of the workpiece, for purposes of grinding a surface of a workpiece so as to effect a change in a dimension of the workpiece, deburring the workpiece, smoothing and polishing a surface of the workpiece, roughing or texturing the surface of a workpiece, and/or cleaning a surface of the workpiece, by forcefully contacting the workpiece with an abrasive article and moving the abrasive article and the workpiece relative to one another.

As utilized herein, including the claims, the term "abrasive particle" refers to particles capable of abrading the surface of a workpiece and includes both (i) individual abrasive particles, and (ii) multiple abrasive particles bonded together with a binder to form abrasive agglomerates such as described in U.S. Pat. Nos. 4,311,489; 4,652,275 and 4,799,939. Abrasive particles useful in the abrasive articles of this invention typically have a Moh's hardness of at least 7.

As utilized herein, including the claims, the term "binder precursor" refers to compositions which can be mixed with solid particulate (e.g. abrasive particles or particles of a grinding aid) and then solidified. Binder precursors include precursors capable of forming thermoplastic or thermosetting resins, with a preference for crosslinked thermosetting resins. Typical binder precursors are liquids under ambient conditions, with a mixture of binder precursor and solid particulates capable of being coated onto a backing. Typical binder precursors are cured by exposing the binder precursor to thermal energy or radiation energy, such as electron beam, ultraviolet light or visible light.

As utilized herein, including the claims, the term "grinding aid" refers to nonabrasive materials capable of improving the abrasion performance of an abrasive article upon a metal workpiece when incorporated into the abrasive coating. Specifically, grinding aids tend to increase the grinding efficiency or cut rate (i.e., the weight of a metal workpiece removed per weight of abrasive article lost) of an abrasive article upon a metal workpiece.

As utilized herein, including the claims, the phrase "consisting essentially of a grinding aid" refers to a nonabrasive composition effective as a grinding aid (i.e., effective for increasing the grinding efficiency or cut rate of an abrasive article) and includes compositions comprised of at least one grinding aid material and optionally one or more additives such as a binder, a diluent, a naturally occurring impurity, etc.

As utilized herein, including the claims, the phrase "initial use," when used to describe the extent to which an abrasive article is used, means the first 10% of the useful life of the abrasive article (e.g., first 100 grams of material removed from workpieces by an abrasive article when a total of 1,000 grams of material can be removed from such workpieces under the same operating conditions before the abrasive article must be replaced).

NOMENCLATURE

10 Abrasive Article (Coated Abrasive)
11 Contoured First Surface of Abrasive Article
12 Peaks
13 Valleys
20 First Backing
21 First Surface of First Backing
22 Second Surface of First Backing
30 Protrusions
30*a* Apex of Protrusions
40 Abrasive Coating
50 Make Coat
60 Abrasive Particles
61*a* Apex of Abrasive Coated Protrusions
61*b* Nadir of Abrasive Coated First Backing
70 Size Coat
80 Supersize Coat
90 Second Backing
91 First Surface of Second Backing
92 Second Surface of Second Backing

ABRASIVE ARTICLE

The abrasive articles 10 of this invention include a first backing 20, protrusions 30 containing a grinding aid attached to the first surface 21 of the first backing 20, and an abrasive coating 40 over the first surface 21 of the first backing 20 and the protrusions 30. The abrasive coating 40 includes abrasive particles 60 bonded to the first backing 20 and the protrusions 30 by a make coat 50, and a size coat 70. The abrasive coating 40 optionally includes a supersize coat 80 over the size coat 70. The abrasive coating 40 covers the first surface 21 of the first backing 20 and the protrusions 30 with a coating of abrasive particles 60 so as to result in an abrasive article 10 having a contoured first surface 11 with a plurality of peaks 12 and valleys 13.

First Backing

The first backing 20 has a first surface 21 and a second surface 22 and can be selected from any conventional abrasive backing material having sufficient structural integrity to withstand the abrading process. Examples of useful backings include polymeric films, primed polymeric films, cloth, paper, vulcanized fiber, fibrous sheets, nonwovens, and combinations thereof A preferred first backing 20 is a treated cloth backing, such as a phenolic/latex treated cloth or cloth treated with other thermosetting resins. Other useful backings include fiber reinforced thermoplastic backings as disclosed in U.S. Pat. No. 5,316,812 and the endless and seamless backings disclosed in U.S. Pat. No. 5,609,706. The backing may optionally be treated for purposes of sealing the backing and/or modifying a physical property or characteristic of the backing. Such treatments are well known in the art.

The first backing 20 may be constructed with an attachment means (not shown) on its second surface 22 for purposes of securing the abrasive article 10 to a support pad (not shown) or back-up pad (not shown). Conventional attachment means include pressure sensitive adhesives, hook and loop attachment systems, and threaded projections such as disclosed in U.S. Pat. No. 5,316,812. Alternatively, the intermeshing attachment system described in U.S. Pat. No. 5,201,101 can be employed.

Grinding Aid

Protrusions 30, containing a grinding aid and preferably consisting essentially of a grinding aid, are formed separately from the other elements of the abrasive article 10 and then securely attached to the first surface 21 of the first backing 20. The protrusions 30 present grinding aid to the working surface of the abrasive article 10 throughout the normal useful life of the abrasive article 10 once the abrasive coating 40 over the peaks 12 formed by the protrusions 30 is removed (typically occurring within the first several seconds of use due to the limited surface area of the abrasive article 10 actually contacting the workpiece (not shown)).

Grinding aids are generally believed to improve the abrasion performance of an abrasive article by (i) decreasing friction between the abrasive particles and the workpiece being abraded, (ii) preventing capping of the abrasive particles (i.e., preventing particles removed from the workpiece from being welded to the tops of the abrasive particles), (iii) decreasing the interface temperature between the abrasive particles and the workpiece, (iv) decreasing the grinding force required to abrade the workpiece, and/or (v) oxidizing metal workpieces. In addition to improving the abrasion performance of an abrasive article, the incorporation of a grinding aid often increases the useful life of the abrasive article.

The protrusions 30 contain a grinding aid, with the protrusions 30 preferably formed from grinding aid alone or as a combination of a grinding aid and a binder. In either form, the protrusions 30 may incorporate other additives that do not adversely affect the erodibility and/or grinding aid functionality of the composition, such as coupling agents, wetting agents, fillers, surfactants, dyes and pigments. Representative examples of organic fillers include wood pulp and wood flour. Representative examples of inorganic fillers include calcium carbonate, calcium metasilicate, silica, fiberglass fibers and glass bubbles. The protrusions 30 specifically exclude any abrasive particles.

Grinding aids useful in the invention encompass a wide variety of different materials including both organic and inorganic compounds. A sampling of chemical compounds effective as grinding aids include waxes, organic halide compounds, halide salts, metals and metal alloys. More specific examples of grinding aid include those selected from the group consisting of halogenated thermoplastics, sulfonated thermoplastics, halogenated waxes, sulfonated waxes, and mixtures thereof.

Specific waxes effective as a grinding aid include specifically, but not exclusively, the halogenated waxes tetrachloronaphtalene and pentachloronaphthalene.

Other organic materials effective as a grinding aid include specifically, but not exclusively, polyvinylchloride and polyvinylidene chloride.

Examples of halide salts generally effective as a grinding aid include sodium chloride, potassium cryolite, sodium cryolite, ammonium cryolite, potassium tetrafluoroborate, sodium tetrafluoroborate, silicon fluorides, potassium chloride, and magnesium chloride. Halide salts employed as a grinding aid typically have an average particle size of less than 100 $\mu$m, with particles of less than 25 $\mu$m preferred.

Examples of metals generally effective as a grinding aid include, antimony, bismuth, cadmium, cobalt, iron, lead, tin and titanium.

Other commonly used grinding aids include sulfur, organic sulfur compounds, graphite and metallic sulfides. Combinations of these grinding aids can also be employed.

Binders suitable for use in the grinding aid protrusions 30 include a wide range of both organic and inorganic materials. Examples of inorganic binders include cement, calcium oxide, clay, silica, and magnesium oxide. Examples of organic binders include waxes, phenolic resins, urea-formaldehyde resins, urethane resins, acrylate resins, aminoplast resins, glue, polyvinyl alcohol, epoxy resins, and combinations thereof.

When the protrusions 30 are formulated with a binder, the percentage of grinding aid in the grinding aid protrusions 30 should be between about 5 to 90 wt %, preferably between about 60 to 90 wt %, with the balance of the protrusions 30 composed of binder and optional additives. When the protrusions 30 are formulated with binder, the protrusions 30 should include at least about 1 wt % binder, preferably about 5 to 10 wt % binder.

Protrusions 30 including a binder can be conveniently made by (i) mixing the grinding aid and any optional components into the binder precursor until a homogeneous blend is obtained, (ii) coating the blend onto a production tool (not shown) having a plurality of recesses of the desired size and shape, (iii) solidifying the coated blend by drying and/or curing the blend with heat and/or radiation energy, and then (iv) removing the solidified protrusions 30 from the production tool by contacting the exposed surface of the solidified protrusions 30 with an adhesive coated web (not shown).

The viscosity of the blend coated onto the production tool should be low enough to allow the blend to fill the recesses in the production tool, yet high enough to prevent the blend from running off the production tool before the blend can be solidified. Solidification can generally be effected by either removing solvent from the mixture and/or curing the binder precursor in the blend.

Protrusions 30 including a thermoplastic binder may optionally include any of a number of additives such as a plasticizer, a stabilizer, a flow agent, a processing aid, and the like.

Protrusions 30 formulated without a binder can be conveniently made by (i) dispersing the grinding aid in an appropriate medium, (e.g., water, acetone, n-heptane, etc.), (ii) coating the dispersion onto the production tool, (iii) solidifying the dispersion by drying the dispersion with heat and/or radiation energy, and then (iv) removing the solidified protrusions 30 from the production tool by contacting the exposed surface of the solidified protrusions 30 with an adhesive coated web (not shown).

The protrusions 30 can be secured to backing 20 by any suitable means, including use of an aggressive adhesive or lamination of the backing 20 onto the exposed surface of the dispersion coated onto a production tool before the dispersion is solidified.

Abrasive Coating

The abrasive coating 40 includes abrasive particles 60, a make coat 50, and a size coat 70. The abrasive coating 40 optionally includes a supersize coat 80 over the size coat 70. The abrasive coating 40 covers the contoured first surface (unnumbered) defined by the first backing 20 and the protrusions 30 with a coating of abrasive particles 60.

MAKE COAT

A make coat binder composition is coated onto the contoured first surface defined by the first backing 20 and protrusions 30 to form a make coat 50. The make coat 50 is preferably coated onto the contoured first surface as a liquid binder precursor, after which the abrasive particles 60 are deposited onto the binder precursor and the binder precursor precured in order to secure the binder precursor and adhesive particles 60 in position.

The binder precursor is precured by exposing the binder precursor to an appropriate precuring amount of energy of the type capable of initiating crosslinking and/or polymerization of the binder precursors. Examples of suitable types of energy effective for curing the types of resins suitable for use as a make coat 50 include thermal energy and radiation energy sources, such as electron beam, ultraviolet light and visible light.

The make coat 50 is typically formed from either a condensation curable thermoset resins or an addition polymerizable thermoset resins. The make coat 50 is preferably comprised of an addition polymerizable thermoset resin as such resins are readily cured by exposure to radiation energy through either a cationic mechanism or a free radical mechanism. Depending upon the specific type of energy used and the specific type of binder precursor employed, a curing agent, initiator, or catalyst may be incorporated onto the binder precursor to facilitate initiation of the crossliking and/or polymerization process.

Types of polymerizable organic resins typically used as the binder precursor of make coats include phenolic resins, urea-formaldehyde resins, melamine-formaldehyde resins, (meth)acrylated urethanes, (meth)acrylated epoxies, ethylenically unsaturated compounds, aminoplast derivatives having pendant α,β unsaturated carbonyl groups, isocyanurate derivatives having at least one pendant (meth)acrylate group, isocyanate derivatives having at least one pendant (meth)acrylate group, vinyl ethers, epoxy resins, and mixtures and combinations thereof.

Phenolic resins are widely used as the make coat in abrasive articles because of their superior thermal properties, ready availability and relatively low cost. Phenolic resins are generally classified as a resole phenolic resins or a novolac phenolic resins based upon the ratio of formaldehyde to phenol in the resin. Resole phenolic resins have a molar ratio of formaldehyde to phenol of greater than or equal to 1:1, often between 1½:1 to 3:1. Novolac phenolic resins have a molar ratio of formaldehyde to phenol of less than 1:1. Examples of commercially available phenolic resins include DUREZ™ and VARCUM™ available from Occidental Chemicals Corp.; RESINOX™ available from Monsanto; and AEROFENET™ and AEROTAP™ available from Ashland Chemical Co.

Acrylated urethanes useful as the make coat in abrasive articles are the diacrylate esters of hydroxyterninated and isocyanate extended polyesters and polyethers. Examples of commercially available acrylated urethanes include UVITHANE 792™, available from Morton Thiokol Chemical, and CMD 6600™, CMD 8400™, and CMD 8805™, available from Radcure Specialties.

Acrylated epoxies useful as the make coat in abrasive articles include the diacrylate esters of epoxy resins, such as the diacrylate esters of bisphenol A epoxy resin. Examples of commercially available acrylated epoxies include CMD 3500™, CMD 3600™, and CMD 3700™, available from Radcure Specialties.

Preferred ethylenically unsaturated compounds are esters resulting from the reaction of an organic moiety containing an aliphatic monohydroxy or aliphatic polyhydroxy group and an unsaturated carboxylic acid. Suitable unsaturated carboxylic acids include acrylic acid, methacrylic acid, itaconic acid, crotonic acid, isocrotonic acid and maleic acid. The ester reaction product preferably has a molecular weight of less than about 4,000. Representative examples of acrylate-based ethylenically unsaturated compounds include methyl methacrylate, ethyl methacrylate, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate.

Aminoplast resins useful as the make coat in abrasive articles include those having at least one pendant α,β unsaturated carbonyl group on each molecule or oligomer. Suitable α,β unsaturated carbonyl groups include acrylate, methacrylate and acrylamide type groups. Suitable aminoplast resins include specifically, but not exclusively, N-(hydroxymethyl)acrylamide, N,N'-oxydimethylenebisacrylamide, ortho and para acrylamidomethylated phenol, acrylamidomethylated phenolic novolac, and combinations thereof. Such materials are described in detail in U.S. Pat. Nos. 4,903,440 and 5,236,472.

Isocyanurate and isocyanate derivatives useful as the make coat in abrasive articles include those having at least one pendant acrylate group. Such compounds are described in detail in U.S. Pat. No. 4,652,274. A preferred isocyanurate derivative is a triacrylate of tris(hydroxyethyl) isocyanurate.

Epoxy resins are polymerized by opening the oxirane ring structure C—O—C. Epoxy resins useful as the make coat in abrasive articles include both monomeric and oligomeric epoxy resins. Examples of suitable epoxy resins include 2,2-bis[4-(2,3-epoxypropoxy)-phenyl propane] (diglycidyl ether of bisphenol A) and the commercially available epoxy resins EPON 828™, EPON 1004™, and EPON 1001F™ available from Shell Chemical Co., and DER-331™, DER-332™, and DER-334™ available from Dow Chemical Co. Other suitable epoxy resins include glycidyl ethers of phenol formaldehyde novolac such as DEN-431™ and DEN-428™ available from Dow Chemical Co.

When employing a free radically curable resin, it is often desirable to incorporate a free radical curing agent for purposes of initiating crosslinking and/or polymerization of the resin. However, it is noted that when an electron beam source is employed as the energy source, a curing agent is generally not required since electron beams are known to generate free radicals directly from the resin.

Examples of suitable free radical thermal initiators include peroxides, (e.g., benzoyl peroxide), azo compounds, benzophenones and quinones. Examples of suitable photoinitiators (i.e., free radical curing agents activated by ultraviolet or visible light), include specifically, but not exclusively, organic peroxides, azo compounds, quinones, benzophenones, nitroso compounds, acryl halides, hydrozones, mercapto compounds, pyrylium compounds, triacrylimdazoles, bisimidazoles, chloroalkytriazines, benzoin ethers, benzil ketals, thioxanthones, acetophenone derivatives, and mixtures thereof A variety of photoinitiators activated by visible light are described in detail in U.S. Pat. No. 4,735,632. A widely used photoinitiator is IRGACURE 369™ available from Ciba Geigy Corporation.

The make coat 50 can optionally include other conventional components in combination with the binder, such as coupling agents, wetting agents, fillers, surfactants, dyes and pigments.

ABRASIVE PARTICLES

Abrasive particles 60 used in the manufacture of abrasive articles typically have a particle size ranging from about 0.1–2,500 μm, usually between about 10 to 700 μm, although larger or smaller particles may also be used. The abrasive particles 60 should have a Mohs' hardness of at least 7, preferably at least 8. Examples of suitable abrasive particles 60 include particles of alumina zirconia, filsed aluminum oxide(including brown aluminum oxide, heat treated aluminum oxide and white aluminum oxide), ceramic aluminum oxide, boron carbide, ceria, chromia, cubic boron nitride, diamond, garnet, iron oxide, silicon carbide (including green silicon carbide), silicon nitride coated silicon carbide, tungsten carbide, and mixtures thereof A detailed discussion of suitable ceramic aluminum oxide particles can be found in U.S. Pat. Nos. 4,314,827, 4,623,364, 4,744,802, and 4,881,951.

The abrasive particles 60 may optionally be coated with a surface coating (not shown) prior to being incorporated into the abrasive article 10. Such surface coatings are used to modifying some property or characteristic of the abrasive particle 60. For example, the abrasive particles 60 may be coated with a surface coating effective for increasing adhesion of the abrasive particles 60 to the make coat 50, or a surface coating effective for altering the abrading characteristics of the abrasive particle 60. Exemplary surface coatings include coupling agents, halide salts, metal oxides such as silica, refractory metal nitrides, refractory metal carbides, and the like.

The abrasive article 10 may optionally include diluent particles (not shown) interspersed within the abrasive particles 60 to achieve a desired loading of abrasive particles on the abrasive article 10. Such diluent particles typically have a particle size on the same order of magnitude as the abrasive particles 60. Examples of such diluent particles include aluminum silicate, flint, glass beads, glass bubbles, gypsum, limestone, marble, silica, and the like.

OPTIONAL SIZE COAT

The abrasive article 10 can optionally include a size coat 70 coated over the abrasive particles 60 embedded within the make coat 50 on the contoured first surface 21 of the base layer 20. As with the make coat 50, the size coat 70 is preferably coated over the abrasive particles 60 as a liquid binder precursor. The size coat 70 is then either precured in preparation for the addition of a supersize coat 80 over the size coat 70, or fully cured, along with the make coat 50, when a supersize coat 80 will not be added to the abrasive article 10.

The size coat precursor can be precured or fully cured by exposing the size coat precursor to the appropriate amount of energy selected from those types of energy capable of crosslinking and/or polymerizing the binder precursors. Examples of suitable types of energy include thermal energy and radiation energy sources, such as electron beam, ultraviolet light and visible light.

The size coat 70 is typically formed from the same condensation curable thermoset resins and addition polymerizable thermoset resins suitable for use as the make coat 50. As with the make coat 50, the size coat 70 can optionally include other conventional components in combination with the binder, such as coupling agents, wetting agents, fillers, surfactants, dyes and pigments. The size coat 70 can also optionally include a grinding aid.

OPTIONAL SUPERSIZE COAT

The abrasive article 10 can further optionally include a supersize coat 80 coated over the size coat 70. As with the size coat 70, the supersize coat 80 is preferably coated onto the size coat 70 as a liquid binder precursor. The size coat 70 is then fully cured, along with the precured size coat 70 and precured make coat 50, to complete the abrasive article 10.

The supersize coat precursor can be fully cured by exposing the supersize coat precursor to an appropriate amount of energy selected from those types of energy capable of crosslinking and/or polymerizing the binder precursors. Examples of suitable types of energy include thermal energy and radiation energy, such as electron beam, ultraviolet light and visible light.

The supersize coat 80 is typically formed from the same condensation curable thermoset resins and addition polymerizable thermoset resins suitable for use as the make coat 50 and size coat 70. As with the make coat 50 and size coat 70, the supersize coat 80 can optionally include other conventional components in combination with the binder, such as coupling agents, wetting agents, fillers, surfactants, dyes and pigments. The supersize coat 80 can also optionally include a grinding aid.

Optional Second Backing

The abrasive article 10 can optionally include a second backing 90 attached to the second surface 22 of the base layer 20. The second backing 90 can be selected from any conventional abrasive backing material having sufficient structural integrity to withstand the abrading process. Examples of useful second backings 90 include polymeric films, primed polymeric films, cloth, paper, vulcanized fiber, fibrous sheets, nonwovens, metal plates, and combinations thereof. A preferred second backing 90 is a treated cloth backing, such as a phenolic/latex treated cloth or cloth treated with other thermosetting resins. Other useful backings include fiber reinforced thermoplastic backings as disclosed in U.S. Pat. No. 5,316,812 and the endless and seamless backings disclosed in U.S. Pat. No. 5,609,706. The second backing 90 may optionally be treated for purposes of sealing the backing and/or modifying a physical property or characteristic of the backing. Such treatments are well known in the art.

The second backing 90 may be constructed with an attachment means (not shown) on its second surface 92 for purposes of securing the abrasive article 10 to a support pad (not shown) or back-up pad (not shown). Conventional attachment means include pressure sensitive adhesives, hook and loop attachment systems, and threaded projections such as disclosed in U.S. Pat. No. 5,316,812. Alternatively, the intermeshing attachment system described in U.S. Pat. No. 5,201,101 can be employed.

METHOD OF MANUFACTURE

Figure 2:
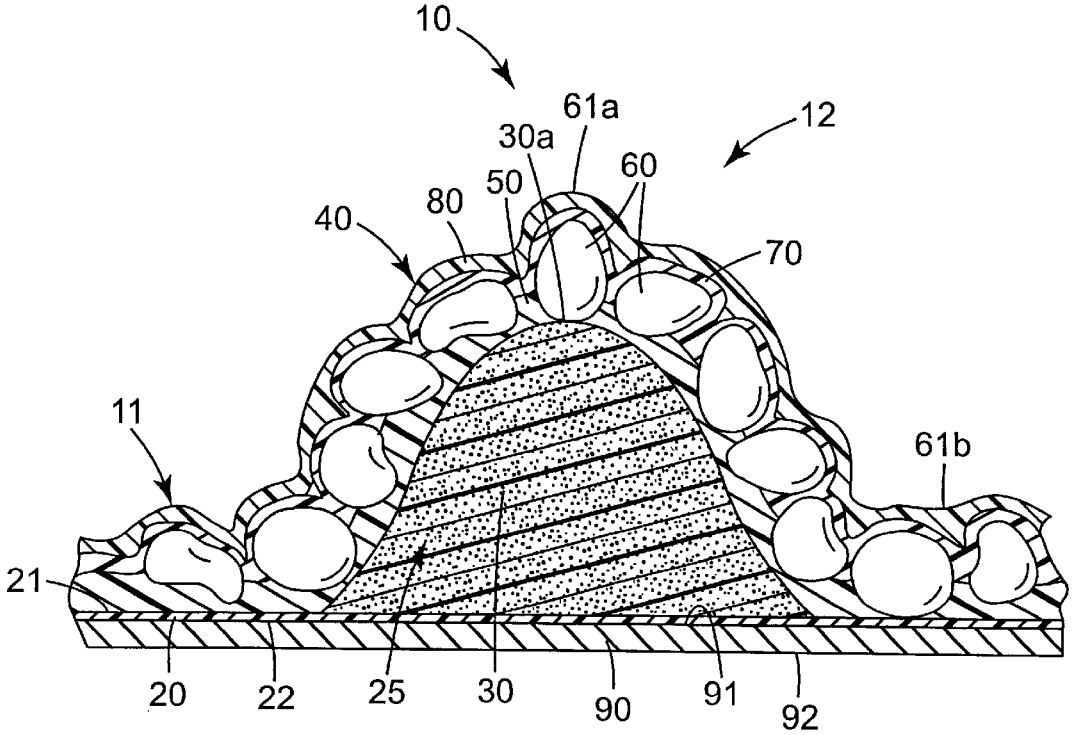
FIG. 2 is an enlarged view of a portion of the invention as shown in FIG. 2.
Figure 3:
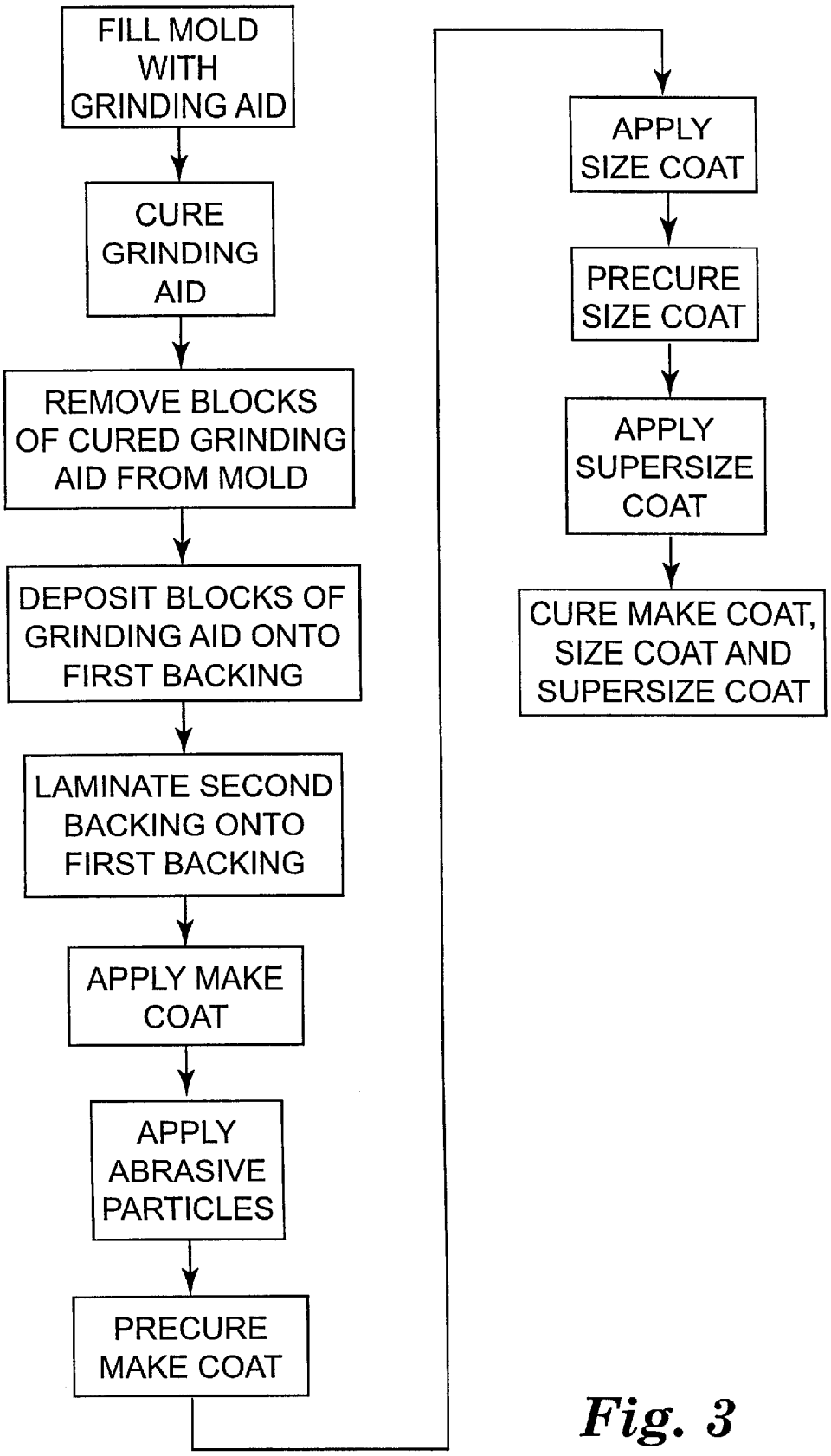
FIG. 3 is a schematic diagram of a method of manufacturing the embodiment of the invention shown in FIG. 1.

The embodiment of the coated abrasive article 10, shown in FIGS. 1 and 2, can be conveniently made by (i) coating a production tool (not shown) having a plurality of recesses (not shown) with a flowable composition containing a grinding aid 30 so as to fill the recesses with grinding aid, (ii) laminating the first backing 20 to the exposed surface of the grinding aid-containing composition coated onto the production tool, (iii) solidifying the grinding aid-containing composition coated onto the production tool by cooling or curing the composition, (iv) removing the laminated first backing 20 and layer of grinding aid-containing composition from the production tool, (v) applying an appropriate binder precursor to the first surface 21 of the first backing 20 and attached protrusions 30 to form make coat 50, (vi) electrostatically coating or drop coating a multiplicity of abrasive particles 60 onto the make coat 50, (vii) precuring the make coat 50 by subjecting the make coat 50 to thermal and/or radiation energy, (viii) applying an appropriate binder precursor over the abrasive particle 60 containing make coat 50 to form size coat 70, and then (xi) fully curing both the make coat 50 and the size coat 70 by subjecting the make coat 50 and size coat 70 to sufficient thermal and/or radiation energy. Optionally, an appropriate binder precursor can be coated over the size coated abrasive particle 60 and cured by the application of sufficient thermal and/or radiation energy to form a fully cured supersize coat 80.

SHAPE GRINDING AID

The grinding aid-containing protrusions 30 are formed as individual pieces capable of being placed or deposited upon the first surface 21 of the first backing 20, whereby the first surface 21 of the first backing 20 is provided with a plurality of spaced grinding aid-containing protrusions 30 defining peaks 12 and valleys 13 on the first surface 21. The first surface 21 of the first backing 20 may be coated with an aggressive adhesive and/or primed for purposes of enhancing adhesion of the protrusions 30 to the first backing 20.

A production tool (not shown) is required to form the protrusions 30. A suitable production tool is essentially a mold having a plurality of recesses (not shown) responsible for generating and defining the shape of the protrusions 30. The recesses can be configured and arranged as a random or arranged pattern of individually spaced or abutting recesses. The recesses can be substantially any desired size and shape so long as the protrusions 30 created within the cavities can be quickly and easily removed from the production tool. It is generally preferred to use recesses with a diminishing cross-sectional area (e.g. truncated cone or truncated pyramid) to facilitate removal of the shaped and cured protrusions 30.

The production tool can be constructed as a belt, a sheet, a continuous sheet or web, a coating roll such as a rotogravure roll, a sleeve mounted on a coating roll, a die, etc. The production tool can be composed of metal, metal alloy or thermoplastic. A metal production tool can be fabricated by any of the conventional techniques used in the construction of such tools, including engraving, bobbing, electroforming, diamond turning, and the like.

A thermoplastic tool can be replicated from a metal master tool (not shown). The master tool is fabricated with recesses identical to the desired configuration of the protrusions 30. The contoured surface of the master tool is pressed against a thermoplastic blank (not shown) so as to provide an inverse impression of the contoured surface in the thermoplastic blank with the individual protrusions 30 separated from one another and any excess thermoplastic between the individual protrusions 30 stripped from the protrusions 30. Alternatively, the thermoplastic can be extruded or cast onto the master tool and then pressed. The metal master tool can be made in the same manner as a metal production tool. Examples of preferred thermoplastic production tool materials include polyester, polycarbonates, polyvinyl chloride, polyethylene, polypropylene and combinations thereof. When using a thermoplastic production tool, care must be exercised to prevent the use and/or generation of excessive heat in order to avoid distortion of the thermoplastic production tool.

The production tool may optionally be fabricated with a release coating (not shown) to facilitate removal of the cured protrusions 30 from the production tool. Examples of such release coatings for metals include hard carbide, nitride or boride coatings. Examples of release coatings for thermoplastics include silicones and fluorochemicals.

An exemplary method of making the protrusions 30 involves the steps of (i) simultaneously conveying a first backing 20 material and the production tool in a machine direction, (ii) coating the production tool with a composition containing a grinding aid by means of a coating station (not shown), (iii) contacting the first backing 20 and the exposed surface of the coated composition, such as by passing the first backing 20 and coated production tool through a nip roller, (iv) at least partially curing or cooling the grinding aid-containing composition as necessary to permit removal of the composition from the production tool, (v) removing the formed protrusions 30 from the production tool by pulling the first backing 20 away from the production tool, and (vi) fully cooling or curing the protrusions 30 as necessary.

The coating station can be selected form any of the conventional coating means such as drop die coater, knife coater, curtain coater, die coater, vacuum die coater, spray coater, roll coater, etc. During coating of the grinding aid-containing composition, the formation of air bubbles should be minimized to the extent possible. The grinding aid-containing composition can be cured by the use of any suitable thermal or radiation energy source. When radiation energy is used to effect partial curing of the grinding aid-containing composition with the production tool, the production tool is preferably constructed from a radiation energy transparent material. As utilized herein, the term "radiation energy transparent" means that the material does not appreciably interact with a specified type of radiation energy such that the specified type of radiation passes through the material without generating appreciable heat or volatilizing the materials.

Alternatively, a highly viscous grinding aid-containing composition can first be coated onto a first backing 20, with the coated first backing 20 brought into contact with the production tool under conditions effective for causing the viscous grinding aid-containing composition to flow into the recesses in the production tool.

The protrusions 30 can have substantially any desired shape, including such geometric shapes as cubes, circular cylinders, cones, frustums of a cone, rods, pyramids, frustums of a pyramid, rectangular parallelepipeds, spherical sectors, tetrahedrons, etc.

For most practical applications, the protrusions 30 are preferably sized and shaped with (i) a height of between about 0.1 mm to about 20 mm, preferably between about 1 mm to about 5 mm, and (ii) a horizontal cross-sectional area of between about 0.03 $mm^2$ to about 50 $mm^2$, preferably about 0.8 $mm^2$ to about 20 $mm^2$.

The protrusions 30 should be sized relative to the size of the abrasive particles 60 such that the ratio of the height of the protrusions 30 relative to the longest linear dimension of the abrasive particles 60 is between about 1:10 to about 10:1, preferably between about 0.5:1 to about 10:1.

In a preferred embodiment, the height of the protrusions 30 and the thickness of the abrasive coating 40 are such that the apex 30*a* of a majority of the protrusions 30, (i.e., the height of the protrusion 30 alone, ignoring the thickness of any abrasive coating 40 over the apex 30*a* of the protrusion 30), extends a distance of about 0.001 mm to about 0.5 mm above at least one adjoining abrasive coated nadir 61*b* (i.e., the height of the nadir 61*b* including the thickness of the abrasive coating 40 filling the nadir 61*b*).

Energy Source

The types of energy suitable for use in curing the binder in the grinding aid, abrasive coating 40, make coat 50, size coat 70 and/or supersize coat 80 include thermal and radiation energy.

The amount of energy required to effect the desired degree of crosslinking and/or polymerization depends upon several factors such as the specific composition to be cured, the thickness of the material, the amount and type of abrasive particles present, and the amount and type of optional additives present. When curing is effected with thermal energy, temperatures between about 300 to 150° C., typically between 40° to 120° C., with an exposure time of from 5 minutes to over 24 hours, are generally effective for curing the coating.

Suitable radiation energy types include electron beam, ultraviolet light, and visible light. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. Visible radiation refers to non-particulate radiation having a wavelength within the range of about 400 to about 800 nanometers, preferably in the range of about 400 to about 550 nanometers. It is preferred to use 300 to 600 watt/inch visible light.

Certain abrasive articles 10 may need to be humidified and flexed prior to use in accordance with standard conditioning procedures.

The abrasive article 10 can be converted into any desired form such as a cone, endless belt, sheet, disc, etc.

PROCESS OF USING

The abrasive article 10 is typically used by bringing the abrasive article 10 into frictional contact with a workpiece (not shown), typically a metal workpiece. The metal workpiece can be any type of metal such as mild steel, stainless steel, titanium, metal alloys, exotic metal alloys and the like. The workpiece may be flat or may have a shape or contour associated with it.

Depending upon the specific application, the force at the abrading interface between the abrasive article 10 and the workpiece can range from about 1 N to over 10,000 N. Generally, the force at the abrading interface ranges from about 10 N to 5,000 N.

Also depending upon the specific application, it may be desirable to provide a lubricating and/or heat transferring liquid between the abrasive article 10 and the workpiece. Common liquids used for this purpose include water, lubricating oils, emulsified organic compounds, cutting fluids, soaps, etc. These liquids may also contain various additives such as defoamers, degreasers, corrosion inhibitors, or the like.

The abrasive article 10 can be used by hand but is preferably mounted upon a machine. At least one, and optionally both, of the abrasive article 10 and the workpiece must be moved relative to the other to effect grinding.

The abrasive article 10 can be converted into a belt, tape roll, disc, sheet, etc., depending upon the desired application. When formed as a belt, the two free ends of the abrasive article 10, formed as a sheet, are joined together and spliced. Endless abrasive belts are typically mounted upon a machine in which the belt traverses an idler roll and a platen or contact wheel. The hardness of the platen or contact wheel is selected to produce the desired application force and rate of cut on the workpiece. In addition, the speed of the abrasive belt relative to the workpiece is selected to effect the desired cut rate and surface finish. Typical abrasive belts range in size from about 5 mm to 1,000 mm wide and from about 5 mm to 10,000 mm long.

Abrasive tapes are simply provided as substantially continuous lengths of abrasive article. Abrasive tapes commonly range in width from about 1 mm to 1,000 mm, generally between 5 mm to 250 mm. Abrasive tapes are usually provided in roll form and used by (i) unwinding the tape from the tape roll, (ii) conveying the unwound tape over a support pad that forces the tape against a workpiece, and then (iii) rewinding the tape. The abrasive tapes can be continuously fed through the abrading interface and can be indexed.

Abrasive discs typically range in size from about 50 mm to 1,000 mm in diameter and are secured to a backup pad by an attachment means. Abrasive discs are commonly used at rotation speeds of about 100 to 20,000 revolutions per minute, typically about 1,000 to 15,000 revolutions per minute.

EXPERIMENTAL TESTING PROCEDURES

PROCEDURE FOR TESTING COATED ABRASIVE (BELT)

The coated abrasive article to be tested is converted into an 80 inch (203 cm) long by 2½ inch (6.3 cm) wide continuous belts and installed upon a THOMPSON reciprocating bed grinding machine. The belt is conventionally flexed to controllably break the hard bonding resins and used to grind the upper face of a stainless steel workpiece having a height of 4 inches (10.2 cm), a width of 1 inch (2.54 cm) and a length of 7 inches (17.78 cm). The abrasive belt is run at a speed of 5,600 ft/min (1,707 m/min) and the table reciprocated relative to the belt at a speed of 100 ft/min (30.5 m/min). The belt is incrementally downfed a distance of 30 $\mu$m after each pass of the workpiece. Grinding was carried out dry except that upper surface of the workpiece was flooded with water and blasted with cool air after each pass in order to cool the abraded surface of the workpiece. Each belt was used until it shelled.

The normal force ($F_n$) and horse power (HP) requirements are measured for each pass.

PROCEDURE FOR TESTING COATED ABRASIVE (DISC)

The coated abrasive article to be tested is cut into a 7 inch (17.8 cm) diameter disc with a ⅞ inch (2.2 cm) diameter center hole and installed on a conventional slide action testing machine. The disc is conventionally flexed to controllably break the hard bonding resins, mounted on a beveled aluminum back-up pad, and used to grind the upper face of a 1 inch (2.5 cm) by 7 inch (18 cm) stainless steel workpiece resulting in a wear path of about 140 $cm^2$ on the disc. The disc is driven at approximately 5,500 rpm with that portion of the disc overlaying the beveled edge of the back-up pad contacting the workpiece at a weight of 5.91 kg.

The workpiece is weighed before and after an abrading cycle of one minute duration to determine the amount of cut (i.e., weight of stainless steel removed from the workpiece). The test is terminated after twelve abrading cycles unless terminated earlier due to excessive wear of the disc as determined by an inability of the disc to remove at least 5 grams of material from the workpiece in a single abrading cycle.

GLOSSARY

The following acronyms, abbreviations, and trade names are used throughout the Examples.

| ACRONYM | DESCRIPTION Full Name | Trademark and Supplier |
|---|---|---|
| RESINS | | |
| BPAS | A composition containing a diglycidyl ether of bisphenol A epoxy resin coatable from an organic solvent. The epoxy equivalent weight ranges from about 185 to about 195. | EPON 828 ™ Shell Chemical Company Houston, Texas. |
| BPAW | A composition containing a diglycidyl ether of bisphenol A epoxy resin coatable from water containing approximately 60% solids, 40% water and a nonionic emulsifier. The epoxy equivalent weight ranged from about 600 to about 700. | CMD 35201 ™ Rhone-Poulene, Inc. Louisville, Kentucky |
| RPI | A resole phenolic resin with 75% solids (non-volatile). | |
| CURING AGENT | | |
| PA | A polyamide curing agent. | VERSAMID 125 ™ Henkel Corporation Cincinnati, Ohio |
| EMI | A 100% solids composition of 2-ethyl-4-methyl imidazole. | EMI 24 ™ Air Products Allentown, Pennsylvania |
| GRINDING AID | | |
| $KBF_4$ | Micropulverized potassium tetrafluoroborate (98% pure). 95 wt % passes through a 325 mesh screen and 100 wt % passes through a 200 mesh screen | |
| CRY | Synthetic Cryolite (trisodium hexafluoroaluluminate). | |
| ADDITIVE | | |
| IO | Red iron oxide. | |
| HP | A liquid mixture of 85 wt % 2-methoxy propanol and 15 wt % water. | |
| DISPERSING AGENT | | |
| AOT | Sodium dioctyl sulfosuccinate. | AEROSOL OT ™ Rohm and Haas Company Philadelphia, Pennsylvania |
| BACKING | | |
| N | Nylon film. | |
| ET-N | Male/Female embossed nylon film embossed with tooling of 0.40 inch (10.2 mm) diameter posts on 0.080 inch (2.0 mm) centers. | |
| PP | Polypropylene film. | |
| ET-PP | Male/Female embossed Polypropylene film embossed with tooling of 0.40 inch (10.2 mm) diameter posts on 0.080 inch (2.0 mm) centers. | |

EXAMPLES

GENERAL PROCEDURE FOR MAKING COATED ABRASIVE

A dispersion of grinding aid and binder is coated onto the female side of an embossed film. The coated dispersion is cured by exposure to a suitable energy source. The exposed surface of the cured dispersion is bonded onto a disc or belt through use of a suitable adhesive and cured. The embossed film is then removed and the contoured exposed surface of the cured dispersion of grinding aid and binder coated with a make coat composition. Abrasive grains are drop coated onto the make coat and the resulting abrasive article pre-cured. A size coat is applied over the abrasive grains and the partially cured make coat, with the make coat and the size coat then fully cured. Optionally, a supersize coat is applied over the fully cured size coat, and then cured to produce a finally cured abrasive article. The finally cured abrasive article is then optionally flexed and conditioned prior to testing.

COMPARATIVE EXAMPLE A, B1 AND B2 AND EXEMPLARY EXAMPLES 1 AND 2

Comparative abrasive articles A, B1 and B2 and exemplary abrasive articles 1 and 2 were manufactured in accordance with the General Procedure for Making Coated Abrasives described above, and tested in accordance with Testing Procedure (Disc) as set forth in Tables 1–3 below.

TABLE 1

(Composition of Abrasive Articles)

| DESIGNATION | BACKING Type | GRINDING AID Comp | MAKE COAT Comp | MAKE COAT Coat Wt. ($g/m^2$) | ABRASIVE GRAINS Type | ABRASIVE GRAINS Coat Wt. ($g/m^2$) | SIZE COAT Comp | SIZE COAT Coat Wt. ($g/m^2$) | SUPERSIZE COAT Comp | SUPERSIZE COAT Coat Wt. ($g/m^2$) |
|---|---|---|---|---|---|---|---|---|---|---|
| Compare A | N | 29.2% BPAW<br>0.35% EMI<br>53.3% $KBF_4$<br>14.1% H2O<br>0.75% AOT<br>2.3% IO | 29% BPAW<br>0.35% EMI<br>53% $KBF_4$<br>14% H2O<br>0.75% AOT<br>2.3% IO | 118 | Grade 80 Ceramic $Al_2O_3$ | 645 | 32% RPI<br>50.2% CRY<br>16.3% HP<br>1.5% IO | 553<br>0.75%<br>2.3% | 29.2% BPAW<br>0.35% EMI<br>53.3% $KBF_4$<br>14.1% $H_2O$<br>AOT<br>IO | 114 |
| Example 1[1] | N | 29.2% BPAW<br>0.35% EMI | 29% BPAW<br>0.35% EMI | 206 | Grade 80 Ceramic | 773 | 32% RPI<br>50.2% CRY | 641 | 29.2% BPAW<br>0.35% EMI | 197 |

TABLE 1-continued (Composition of Abrasive Articles)

| DESIG-NATION | BACK-ING Type | GRINDING AID Comp | MAKE COAT Comp | MAKE COAT Coat Wt. (g/m²) | ABRASIVE GRAINS Type | ABRASIVE GRAINS Coat Wt. (g/m²) | SIZE COAT Comp | SIZE COAT Coat Wt. (g/m²) | SUPERSIZE COAT Comp | SUPERSIZE COAT Coat Wt. (g/m²) |
|---|---|---|---|---|---|---|---|---|---|---|
| | | 53.3% $KBF_4$<br>14.1% H2O<br>0.75% AOT<br>2.3% IO | 53% $KBF_4$<br>14% H2O<br>0.75% AOT<br>2.3% IO | | $Al_2O_3$ | | 16.3% HP<br>1.5% IO | 0.75%<br>2.3% | 53.3% $KBF_4$<br>14.1% $H_2O$<br>AOT<br>IO | |
| Compare B1 | PP | 29.2% BPAW<br>0.35% EM<br>53.3% $KBF_4$<br>14% H2O<br>0.75% AOT<br>2.3% IO | 40% BPAS<br>18% PA<br>.02% RD-2<br>12% HP<br>28% $CaCO_3$ | 263 | Grade 50<br>Ceramic<br>$Al_2O_3$ | 965 | 32% RPI<br>50.2% CRY<br>16.3% HP<br>1.5% IO | 548 | N/A | N/A |
| Compare B2 | PP | 29.2% BPAW<br>0.35% EMI<br>53.3% $KBF_4$<br>14% H2O<br>0.75% AOT<br>2.3% IO | 40% BPAS<br>18% PA<br>.02% RD-2<br>12% HP<br>28% $CaCO_3$ | | Grade 50<br>Ceramic<br>$Al_2O_3$ | | 32% RPI<br>50.2% CRY<br>16.3% HP<br>1.5% IO | | 29.2% BPAW<br>0.35% EMI<br>53.3% $KBF_4$<br>14.1% $H_2O$<br>0.75% AOT<br>2.3% IO | |
| Example 2[2] | N | 29.2% BPAW<br>0.35% EMI<br>53.3% KBF<br>14% H2O<br>0.75% AOT<br>2.3% IO | 40% BPAS<br>18% PA<br>.02% RD-2<br>12% HP<br>28% $CaCO_3$ | | Grade 50<br>Ceramic<br>$Al_2O_3$ | | 32% RPI<br>50.2% CRY<br>16.3% HP<br>1.5% IO | | N/A | N/A |

[1]The female side of a grinding aid coated embossed ET-N backing was bonded to the nylon disc with an adhesive (50/50 mixture of resole phenolic resin and $CaCO_3$) and the embossed ET-N backing removed after the adhesive was cured at 100° C. for 1 hour, leaving the contoured grinding aid bonded to the nylon disc.

[2]The female side of a grinding aid coated embossed ET-PP backing was bonded to a nylon disc with an adhesive (68% BPAS, 30% PA, 02% RD-2) and the embossed ET-PP backing removed after the adhesive was cured at 100° C. for 1 hour, leaving the contoured grinding aid bonded to the nylon disc.

TABLE 2

(Curing and Conditioning of Abrasive Articles)

| DESIG-NATION | MAKE COAT CURE CONDI-TIONS Time (min) | MAKE COAT CURE CONDI-TIONS Temp (° C.) | SIZE COAT CURE CONDI-TIONS Time (min) | SIZE COAT CURE CONDI-TIONS Temp (° C.) | SUPER-SIZE COAT CURE CONDI-TIONS Time (min) | SUPER-SIZE COAT CURE CONDI-TIONS Temp (° C.) | FINAL CONDI-TIONING Time (min) | FINAL CONDI-TIONING RH (%) |
|---|---|---|---|---|---|---|---|---|
| Compare A | 90 | 90 | 11½ | 90 | 90 | 100 | — | — |
| Example 1 | 90 | 90 | 11½ | 90 | 90 | 100 | — | — |
| Compare B1 | 90 | 90 | 11½ | 90 | 90 | 100 | — | — |
| Compare B2 | 90 | 90 | 11½ | 90 | 90 | 100 | — | — |
| Example 2 | 90 | 90 | 11½ | 90 | 90 | 100 | — | — |

TABLE 3

(Testing (Disc) of Abrasive Articles)

| ABRASIVE ARTICLE | TYPE OF STEEL | CUT 1st Cycle (g) | CUT Last Cycle (g) | CUT Total Cut (g) |
|---|---|---|---|---|
| Compare A | 304 Stainless | 45 | 12 | 306 |
| Example 1[1] | 304 Stainless | 32 | 14 | 245 |
| Compare B1 | 304 Stainless | 25 | 7 | 104 |
| Compare B2 | 304 Stainless | 32 | 4 | 120 |
| Example 2 | 304 Stainless | 29 | 10 | 159 |

TABLE 3-continued (Testing (Disc) of Abrasive Articles)

| ABRASIVE ARTICLE | TYPE OF STEEL | CUT 1st Cycle (g) | CUT Last Cycle (g) | CUT Total Cut (g) |
|---|---|---|---|---|

[1]Worn samples indicated limited wearing of grinding aid. Grinding aid believed to be too hard for use under test conditions (13 lb load).

Conclusions

Abrasive articles formed in accordance with the present invention have an extended useful life span. In addition, it is noted that when the ratio of the length of the abrasive grains and the height of the grinding aid protrusions approach 1:1, (as is the case for Examples B1, B2 and 2, but not for Examples A and 1) the overall cutting performance of the abrasive article is also enhanced.

What is claimed is:

1. A method of making an abrasive article comprising:

(a) forming grinding aid-containing protrusions, wherein the grinding aid is selected from the group consisting of organic compounds, halide salts, and combinations thereof, (b) attaching the protrusions to a first surface of a first backing to form a contoured first surface, and (c) coating abrasive particles onto the contoured first surface, whereby the protrusions are coated with abrasive particles.

2. The method of claim 1, wherein the abrasive particles are coated onto the contoured first surface such that any abrasive particles covering the peaks of the protrusions are worn away upon initial use of the abrasive article so as to allow the protrusions to contact a workpiece.

3. The method of claim 1, further comprising adhering a second backing to the second surface of the first backing.

4. The method of claim 1, wherein the protrusions consist essentially of a grinding aid.

5. The method of claim 1, wherein the protrusions are free of abrasive particles.

6. The method of claim 5, wherein the grinding aid is selected from the group consisting of halogenated thermoplastics, sulfonated thermoplastics, waxes, halogenated waxes, sulfonated waxes, halide salts, and mixtures thereof.

7. The method of claim 6, wherein the abrasive particles are coated onto the contoured first surface such that any abrasive particles covering the peaks of the protrusions are worn away upon initial use of the abrasive articic so as to allow the protrusions to contact a workpiece.

8. The method of claim 6, further comprising adhering a second backing to the second surface of the first backing.

9. The method of claim 6, wherein the protrusions consist essentially of a grinding aid.

10. The method of claim 6, wherein each protrusion has a horizontal cross-sectional area of between about 0.03 to about 50 $mm^2$.

11. The method of claim 6, wherein coating abrasive particles onto the contoured first surface includes sequentially coating the contoured first surface with (i) a make coat, (ii) abrasive particles, and (iii) a size coat.

12. The method of claim 6, wherein each protrusion has a height of between about 0.1 mm to about 20 mm.

13. The method of claim 6, wherein the protrusions are generally shaped as a cube, a circular cylinder, a cone, a frustum of a cone, a pyramid, a frustum of a pyramid, a rectangular parallelepiped, a spherical sector, or a tetrahedron.

14. The method of claim 1, wherein the grinding aid is selected from the group consisting of halogenated thermoplastics, sulfonated thermoplastics, waxes, halogenated waxes, sulfonated waxes, halide salts, and mixtures thereof.

15. The method of claim 14, wherein the abrasive particles are coated onto the contoured first surface such that any abrasive particles covering the peaks of the protrusions are worn away upon initial use of the abrasive article so as to allow the protrusions to contact a workpiece.

16. The method of claim 14, further comprising adhering a second backing to the second surface of the first backing.

17. The method of claim 14, wherein the protrusions consist essentially of a grinding aid.

18. The method of claim 14, wherein the protrusions are free of abrasive particles.

19. The method of claim 14, wherein each protrusion has a horizontal cross-sectional area of between about 0.03 to about 50 $mm^2$.

20. The method of claim 14, wherein coating abrasive particles onto the contoured first surface includes sequentially coating the contoured first surface with (i) a make coat, (ii) abrasive particles, and (iii) a size coat.

21. The method of claim 14, wherein each protrusion has a height of between about 0.1 mm to about 20 mm.

22. The method of claim 14, wherein the protrusions are generally shaped as a cube, a circular cylinder, a cone, a frustum of a cone, a pyramid, a frustum of a pyramid, a rectangular parallelepiped, a spherical sector, or a tetrahedron.

23. The method of claim 1, wherein each protrusion has a horizontal cross-sectional area of between about 0.03 to about 50 $mm^2$.

24. The method of claim 1, wherein coating abrasive particles onto the contoured first surface includes sequentially coating the contoured first surface with (i) a make coat, (ii) abrasive particles, and (iii) a size coat.

25. The method of claim 1, wherein each protrusion has a height of between about 0.1 mm to about 20 mm.

26. The method of claim 1, wherein the protrusions are generally shaped as a cube, a circular cylinder, a cone, a frustum of a cone, a pyramid, a frustum of a pyramid, a rectangular parallelepiped, a spherical sector, or a tetrahedron.

* * * * *

UNITED STATES PATENT AND TRADEMARK OFFICE

CERTIFICATE OF CORRECTION

PATENT NO. : 6,312,315 B1
DATED : November 6, 2001
INVENTOR(S) : Gagliardi, John J.

It is certified that error appears in the above-identified patent and that said Letters Patent is hereby corrected as shown below:

Title page,
Item [56], U.S. PATENT DOCUMENTS, add the following patent -- 5190568 B1 3/1996 Tselesin --

Column 2,
Line 34, "usefully" should read -- useful --.

Column 5,
Line 51, "tetrachloronaphtalene" should read -- tetrachloranaphthalene --

Column 7,
Lines 12 and 36, "resins" should read -- resin --.
Line 13, "resins" should read -- resin -- in both instances.
Line 44, "AEROFENET™" should read -- AEROFENE™ --.

Column 9,
Line 3, "filsed" should read -- fused --.
Line 10, insert -- . -- following "thereof".
Line 16, "modifying" should read -- modify --.

Column 10,
Line 66, "(xi)" should read -- (ix) --.

Column 13,
Line 5, "300" should read -- 30º --.

Column 14,
Line 23, "belts" should read -- belt --.

Column 15,
Line 39, "hexafluoroaluluminate" should read -- hexafluoroaluminate --.
Line 16, Table 1, realign supersized "coat" comp entries.

Column 17,
Line 18, Table 1, realign supersized "coat" comp entries.

UNITED STATES PATENT AND TRADEMARK OFFICE

CERTIFICATE OF CORRECTION

PATENT NO. : 6,312,315 B1
DATED : November 6, 2001
INVENTOR(S) : Gagliardi, John J.

It is certified that error appears in the above-identified patent and that said Letters Patent is hereby corrected as shown below:

Column 19,
Line 18, "articic" should read -- article --.

Signed and Sealed this

Seventeenth Day of June, 2003

JAMES E. ROGAN
*Director of the United States Patent and Trademark Office*